United States Patent [19]

Ferroni

[11] 4,456,322

[45] Jun. 26, 1984

[54] LAMP WATTAGE LIMITING DEVICE

[76] Inventor: Frank A. L. Ferroni, 108 Chateau St. Michel Dr., Kenner, La. 70062

[21] Appl. No.: 258,297

[22] Filed: Apr. 28, 1981

[51] Int. Cl.[3] ..... H01R 13/64; H01R 17/20; H01R 27/00

[52] U.S. Cl. ..... 339/153; 200/51.09; 339/180; 339/184 L

[58] Field of Search ..... 339/36, 40, 42, 176 L, 339/180, 184 R, 184 L, 184 T, 111, 31 L, 93 L, 153, 88 R, 88 C; 200/51.09

[56] References Cited

U.S. PATENT DOCUMENTS

| | | | |
|---|---|---|---|
| 438,310 | 10/1890 | Edison | 339/31 L |
| 656,284 | 8/1900 | Froschl | 339/180 |
| 1,910,482 | 5/1933 | Stoddard | 339/180 |
| 2,221,345 | 11/1940 | Davis | 339/40 |
| 2,523,357 | 9/1950 | Chirelstein | 339/180 |
| 2,688,669 | 9/1954 | Quill | 339/180 |
| 2,747,168 | 5/1956 | Arena | 339/176 L |
| 3,514,742 | 5/1970 | Reinherz | 339/88 R |

*Primary Examiner*—Neil Abrams

*Attorney, Agent, or Firm*—Cushman, Darby & Cushman

[57] ABSTRACT

A lamp holder and lamp arrangement is provided to inhibit insertion of lamps having wattages greater than that for which the lamp holder is designed. A ring assembly having springs with upper and lower arms is mounted at the bottom of the lamp socket. A contact member having a predetermined geometric configuration of contact button is captured between the upper and lower spring arms. A lamp of proper wattage rating has a base center contact with a corresponding geometric configuration, so that screwing in the lamp mates the geometric configurations, thereby overcoming the spring bias of the spring lower arm, and permitting electrical contact between the contact button and a contact in the bottom of the lamp socket.

8 Claims, 5 Drawing Figures

LAMP WATTAGE LIMITING DEVICE

This invention pertains to a lamp holder. More specifically, this invention pertains to a lamp holder wherein means are incorporated to prevent use of a lamp of a higher wattage than that for which the amp holder is rated.

A common problem in the field of electrical lighting is what is known as "overlapping." This term refers to the practice of putting lamps of a particular high wattage rating into sockets or holders which may be have been designed by their manufacturers for mounting lamps of a lower wattage. Clearly, such a practice can lead to a danger of fire, or injury, by installing higher wattage lamps in lighting fixtures that were not designed for such wattages, not to mention the possibility of damage to the lighting fixture by such practice.

It is an object of this invention to provide a method and apparatus for mounting lamps to lamp holders wherein the installation of a lamp with a higher wattage rating than a lamp holder is designed to receive is inhibited.

It is a more specific object of this invention to provide a lamp holder and lamp arrangement whereby, for a lamp holder of a particular wattage rating, only lamps of that particular and lower wattage ratings are operative.

It is another object of this invention to provide a lamp holder construction wherein the possibility of accidental electrical shock from contact with the lamp holder with no lamp mounted therein is decreased.

It is another object of this invention to provide a lamp holder and lamp assembly in which the possibility of the lamp becoming loosened in the lamp holder from vibration and the like is decreased.

Briefly, in accordance with one embodiment of the invention, a screw-in type lamp holder of conventional configuration is utilized. Such a lamp holder has an insulated shell enclosing an electrically conductive socket which is threaded for receiving a lamp. There is also provided a centrally located second electrical contact at the bottom of the lamp holder. In accordance with the invention, resilient mounting means are provided in the lamp holder beneath its screw threaded portion. A contact member is also provided of an insulating material, but which has a centrally located electrically conductive button. The contact member is mounted by the resilient mounting means in the lamp holder in a fashion such that the electrically conductive button is aligned with but spaced from the second electrical contact in the bottom of the lamp holder. The electrically conductive button has a geometric configuration selected in accordance with a particular wattage rating. A lamp is provided of a configuration having a base with a screw threaded portion forming one electrical contact and a centrally located second electrical contact in the bottom thereof. In accordance with the invention, the second electrical contact of the lamp is geometrically configured so that, for a corresponding wattage rating, its configuration is of a mating relationship with the configuration of the electrically conductive button. In assembly of a lamp of a particular wattage rating to a lamp holder of a corresponding wattage rating, the second centrally located contact of the lamp mates with the electrically conductive button so that contained screwing-in of the lamp biases the contact member against the resilient means so that the electrically conductive button makes electrical contact with the second centrally located electrical contact of the lamp holder. In accordance with various aspects of the invention, the centrally located contacts of lamps of various wattage ratings and the geometric configuration of the electrically conductive button of a particular wattage rating will mate only with electrical contacts of lamps of a corresponding and lower wattage rating.

BRIEF DESCRIPTION OF THE DRAWINGS

Further objects, features and advantages of the invention will become apparent upon consideration of the following detailed description taken in conjunction with the accompanying drawings, in which.

DETAILED DESCRIPTION

Figure 1:
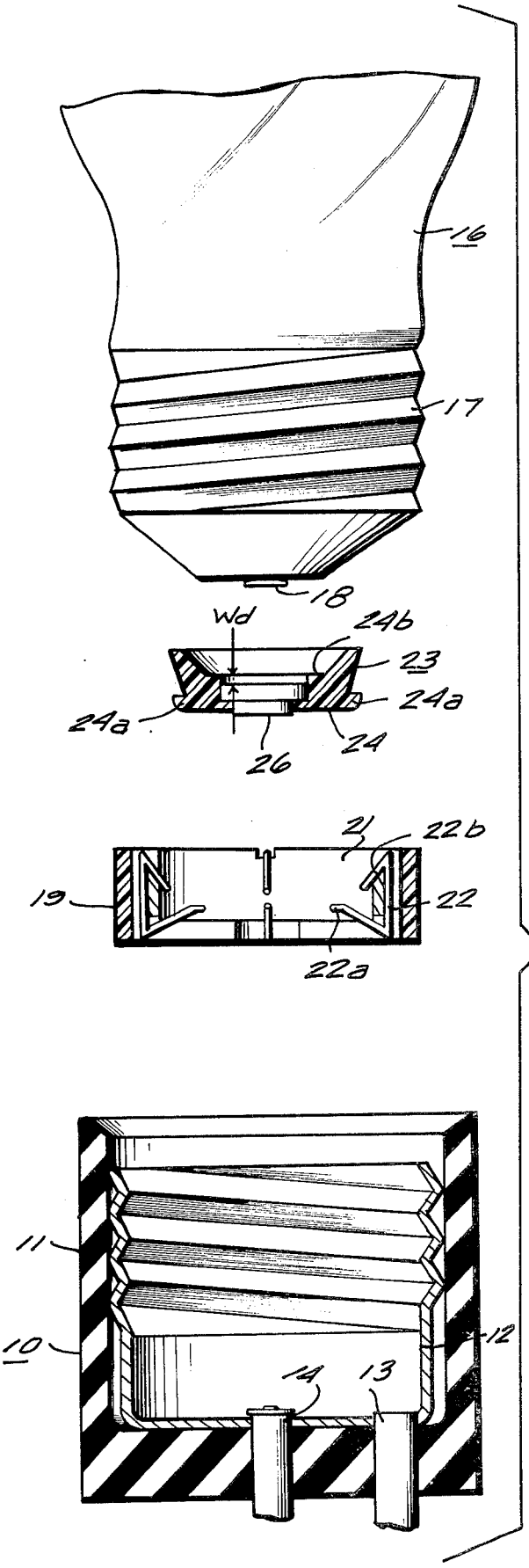
FIG. 1 is an exploded view showing the manner is which a lamp socket receives resilient mounting means and a contact member for cooperative relationship with a lamp base.
Figure 2:
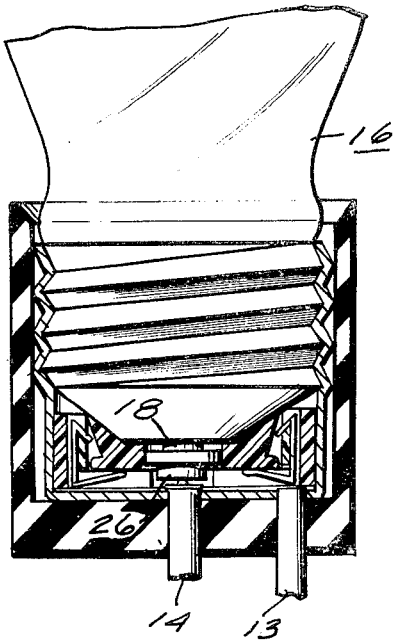
FIG. 2 is similar to FIG. 1 but shows the various apparatus of FIG. 1 in an assembled relationship.

Referring to FIGS. 1 and 2 there is shown a conventional screw-in type electrical fixture or socket generally indicated by reference numeral 10. Such a lamp holder includes an insulated shell 11 enclosing an electrically conductive socket 12 which is threaded for receiving a lamp in screw-in relationship. A first electrical contact 13 is provided connected or coupled to the threaded socket 12. A second electrical contact 14 is provided in a generally centrally located bottom portion of the socket.

FIG. 1 shows a lamp generally indicated by reference numeral 16. The lamp has a screw threaded base portion 17 which is threaded for engagement with the threads in a socket in a lamp holder. The threaded portion 17 is made of electrically conductive material and constitutes one electrical connection between the lamp and a socket. The second electrical connection for the lamp to a socket is provided by a second electrical contact 18 provided at the bottom of the lamp base and insulated from the portion 17.

In accordance with the invention, resilient biasing means are provided for insertion into the lamp socket 10. In the embodiment shown in FIGS. 1 and 2 this resilient biasing means comprises an outer ring 19 conveniently formed of plastic or the like insulating material and an inner ring 21 also conveniently formed of plastic or other insulating material. The outer and inner rings 19 and 21 are adapted to be assembled as shown to capture a plurality of spring members 22 there between. A plurality of spring members 22, for example four, can be provided, with each of the spring members having a lower spring arm **22*a* and an upper spring arm 23*b*. In assembled form, the resilient biasing means comprising outer ring 19, inner ring 21, and spring members 22 is inserted into the socket 10 so that it rests in the bottom portion thereof beneath the threaded portions as shown in FIG. 1**.

A contact member 23 is provided in accordance with the invention. The contact member 23 comprises an insulating member 24 which can be of a generally circular configuration having an electrically conductive button portion 26 formed thereon generally at a central location thereof. In the embodiment shown in FIG. 1, the contact member 23 has arm portions 24*a* in its insulating portion. In assembled form, the contact member 23 is inserted down into the lamp socket so that the arms 24*a* are captured between the lower spring arm 22*a* and the upper spring arm 22*b* of the respective spring members 22. In such an assembled form, the resilient biasing means mounts the contact member in the lamp socket 10 so that the electrically conductive button portion 26 is generally aligned with but spaced from the second electrical contact 14 of the lamp socket 10.

In accordance with the invention, the electrically conducting button portion 26 on the contact member 23 is designed to have a specific, selected geometric configuration that corresponds to a particular wattage rating for the lamp socket 10. Conjointly, the second electrical contact 18 of the lamp base is also configured in geometric dimensions to correspond to the wattage of the lamp 16. In its overall aspect, this invention provides mating geometric configurations of the electrically conductive button 26 on contact member 23 and central contacts 18 on lamps where the wattage rating of the contact member 23 and that of the lamp 16 correspond. In the example shown in FIG. 1, the contact button is shown as having a female configuration for mating with a corresponding male configuration 18 on the lamp 16. For example, a contact button for a 100 watt lamp can be provided positioned at a distance $W_d$ below a top insulating surface 24*b* of the insulating portion of the contact member. For such a configuration, the central contact 18 of lamp 16 is also provided of a configuration or length that is equal to or just slightly greater than the dimension $W_d$, where the lamp 16 is of a 100 watt rating. Then, upon assembling the 100 watt lamp into the socket 10 that has the 100 watt contact member 23 provided therein, the contact 18 of the lamp will make contact with the electrically conductive button 26 as the lamp is screwed into the socket. Continued screwing in of the lamp into the socket will cause the contact member 23 to be biased downwardly against the spring tension of the springs 22 so that the contact button 26 makes electrical contact with the central contact 14 in socket 10, as shown in FIG. 2 and the lamp will operate.

In accordance with one way of implementing the present invention, the distance $W_d$ corresponds to a maximum wattage rating for which the socket 18 is suited. The length of electrical contact 18 in the lamp base is made proportional to the wattage rating of the lamp 16, with the length of the contact 18 being inversely proportional to the wattage rating. That is, in the example discussed above, the contact 18, for a 100 watt rating, would be in correspondence with the distance $W_d$ for a 100 watt rated contact member 23. For lamps of a lower wattage rating, such as 60 watt for example, the length of electrical contact 18 would be made longer, so that such lower wattage rated lamps would also operate in the 100 watt rated contact member 23 is assembled relation in the socket 10. Conversely, lamps of a higher wattage rating, such as 150 watts, for example, would have a shorter length central electrical contact 18. If it is attempted to insert such a higher rated lamp into a lower rated contact member 23, the central contact 18 of the higher wattage rated lamp will be so short that it will not extend over the distance $W_d$, so that no electrical contact is made between the contact 18 and the centrally conducting button 26.

Of course, it is only necessary in accordance with the invention that the central contacts 18 of the various wattage rated lamps and the electrically conductive buttons 26 of the various wattage rated contact members 23*b* are appropriately geometrically configured for mating relationship. Although the specific example discussed above utilized length of the central contact member 18 and a corresponding depth dimension $W_d$ of the contact button 26, it would also be possible to use diameters. In such a case, then the diameter of the central contact 18 would be coded so as to have a particular dimension in accordance with the wattage rating of the lamp 16. The diameter of the conductive button 26 would then be such that mating contact would only be made with lamps having a corresponding or lower wattage rating.

By the means discussed above, it can be seen that the present invention provides a mechanism for inhibiting the use of lamps in a socket where the lamps have a higher wattage rating than that for which the socket is designed. Another feature of the present invention which should become apparent from the above description, is that the possibility of an accidental electrical shock is decreased by the present invention for cases where there is no lamp inserted into a socket. That is, with the resilient biasing means and contact member 23 installed in an electrical socket, the contact button 26, although being aligned with the central contact 14 of the socket is nevertheless spaced therefrom so that no electrical connection exists thereacross. Therefore, someone accidentally inserting their finger into a socket would only come into contact with the contact button 26, which is not in electrical connection with the contact 14. Therefore, such possibility of accidental shock would be decreased.

It should also become apparent from the above description that the present invention also provides a desirable feature of providing a spring biasing force acting on the lamp when it is assembled into a socket. That is, the pressure from the springs 22 exerted through contact member 23 upon the base portion of lamp 16 would keep the threaded portion 17 of the lamp held tightly in the threaded portion of the socket 10. This would be desirable in instances where lamp fixtures are subjected to forces such as vibration and the like which might otherwise tend to loosen the screw threaded base 17 from the threaded portion of the socket 10.

Figure 3:
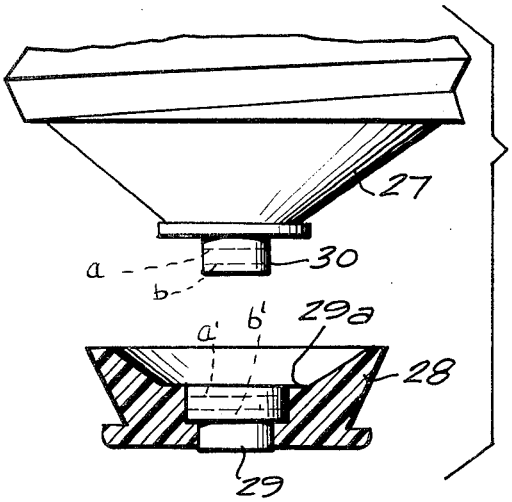
FIG. 3 illustrates the mating relationship between the central contact of a lamp base and a electrically conductive button of a contact member provided in the lamp socket in accordance with the invention.

FIG. 3 illustrates in a diagrammatic fashion a portion of a lamp base 27 and associated contact member 28. The lamp base portion 27 is provided with a central contact 30, which in accordance with various wattage ratings can be of a selected length, as diagrammatically illustrated by the dashed lines a and b extending across the contact 30. In like fashion, the contact member 28 is provided with a centrally located conductive button 29, which is provided at a location at or below a top surface 29*a* of the contact member 28 in dependence upon the wattage rating of the contact member 28. This "coding" of the contact member 28 is indicated by the dashed lines a' and b' extending across the upper portion of conductive button 29.

Figure 4:
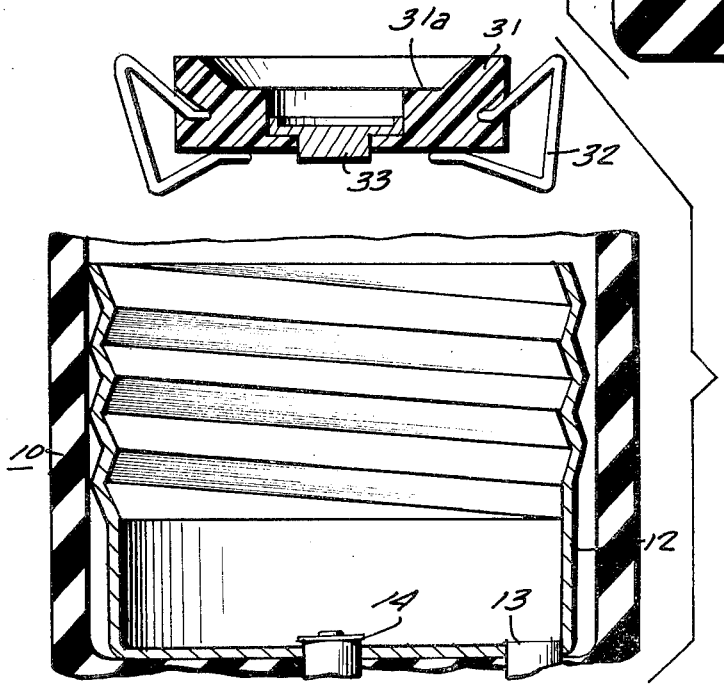
FIG. 4 illustrates an embodiment of the invention in which an assembly of a resilient mounting means and a contact member is provided for insertion into existing lamp sockets in the field.

FIG. 4 illustrates another embodiment of the invention. In FIG. 4 the lamp socket portions are identical to that discussed in FIG. 1 and are therefore given the same reference numerals. In the arrangement of FIG. 4 the contact member comprises a single insulating member 31 having appropriate apertures in its periphery for receiving a plurality of spring members 32. As in the other embodiments, a centrally located conductive button 33 is provided in the contact member that is geometrically configured, with relationship to a top surface 31*a* of insulating member 31, so that it corresponds to a particular wattage rating. In the arrangement of FIG. 4 the resilient mounting means consisting of springs 32 can be assembled to the contact member 31, and the assembly inserted into the bottom of the lamp socket 10. In such an assembled relationship, the assembly would be held in place in the bottom of the socket by the cooperation between the spring members 32 and the sidewalls of the conductive portion 12 of the socket 10. The spring members 32 would serve to hold the electrically conductive button 33 in a spaced, but aligned, relationship with the central electrical contact 14 of the socket 10. A feature of the embodiment of FIG. 4 is that existing conventional lamp sockets that are already in the field could be functionally modified to only accept lamps of a particular or lower wattage rating by simply assembling the resilient biasing means and contact member therein.

Figure 5:
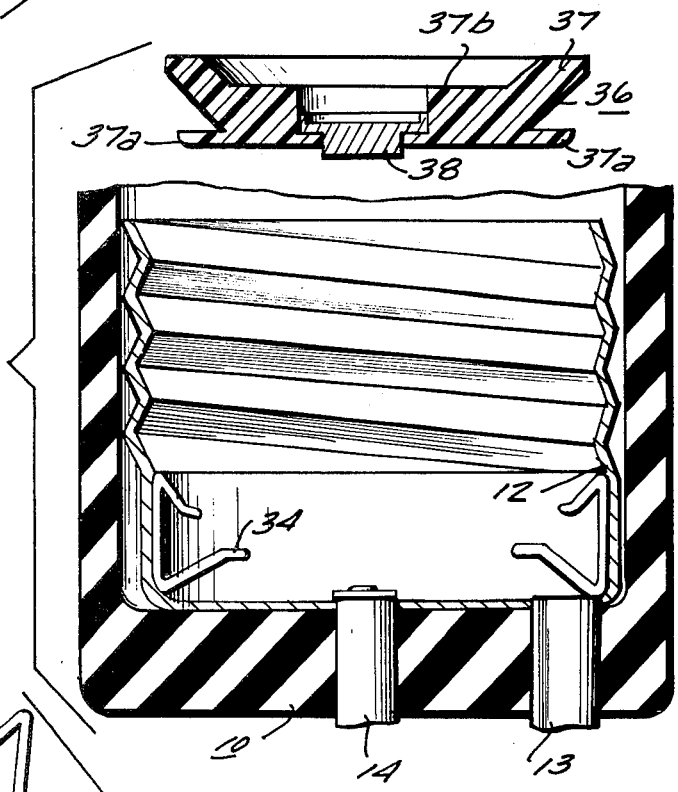
FIG. 5 is an illustration of an embodiment of the invention in which the resilient mounting means are incorporated in the lamp socket at the time of manufacture, and a separate contact member can be installed therein at anytime, either at the time of manufacture or in the field.

FIG. 5 shows another possible embodiment of the present invention in which resilient biasing means are incorporated into a lamp socket at the time of its manufacture. Thus, as shown in FIG. 5, resilient biasing means can be provided in the form of spring members 34 which are mounted within and to the bottom portion of the electrically conductive portion 12 of lamp socket 10. The spring members 34 can be fastened to the wall of the portion 12 by any convenient means, such as welding, soldering, or gluing, so that they are retained in place. Then, the lamp socket can be appropriately coded by inserting, either at the time of manufacture of the lamp socket or in the field, an appropriately coded contact member 36. As before, the contact member 36 comprises an insulating portion 37 having flanged portions 37*a* for capture between the arms of the spring members 34. Also, as before, an electrically conductive button 38 is provided in a generally central location of the contact member 36 and with a geometric configuration with respect to a top surface 37*b* of the insulating portion 37 that is coded in accordance with the particular desired wattage rating.

Although the invention has been described with respect to presently contemplated preferred embodiments, it should be obvious to those skilled in this art that variations are possible to the herein disclosed specific embodiments without departing from the true spirit and scope of the invention.

I claim:

1. In a lamp holder for light fixtures including a lamp holder having an insulated shell enclosing an electrically conductive socket which is threaded for receiving a lamp in screw-in relationship, and further including a first electrical contact connected to the electrically conductive socket and a second electrical contact generally centrally located in the bottom of the lamp holder and insulated from the electrically conductive socket, a wattage limiting and safety device comprising an insulating ring assembly being hollow at its center and at least one spring member mounted in its periphery, said insulating ring assembly being positioned within the electrically conductive socket so as to rest at the bottom thereof with the at least one spring member having an upper and lower spring arm both extending towards the center of the electrically conductive socket, a contact member comprising an insulated carrier having an electrically conductive button centrally located thereon and having arm portions at its periphery, said contact member being insertable into the electrically conductive socket whereby the upper and lower spring arms of said at least one spring member capture the arm portions of said contact member between them to retain it within said socket, said lower spring arm mounting said contact member such that in an unbiased condition said electrically conductive button is aligned with but spaced from the second electrical contact generally centrally located in the bottom of the lamp base, said electrically conducting button having a selected geometric configuration corresponding to a particular lamp wattage rating, said selected geometric configuration corresponding in a mating relationship with the geometric configuration of the centrally located electrical contact of a lamp base of corresponding wattage rating, whereby as a lamp of corresponding wattage rating is screwed into the lamp socket, its centrally located electrical contact mates with the selected geometric configuration of the contact member so that continued screwing-in of said lamp overcomes the bias of said lower spring arm to make electrical contact between the lamp socket central electrical contact and said electrically conductive button.

2. Apparatus in accordance with claim 1 wherein the geometric configurations of said electrically conductive button and the centrally located electrical contact of a lamp are selected such that said electrically conductive button of a geometric configuration corresponding to a particular wattage mates with the electrical contact of a lamp of that particular and lower wattages, and does not mate with the electrical contact of said lamp if said lamp is of a higher wattage rating.

3. A lamp holder including a wattage limiting feature comprising an insulated shell enclosing an electrically conductive socket which is threaded for receiving a lamp in screw-in relationship, said lamp holder including a first electrical contact connected to the electrically conductive socket and a second electrical contact generally centered in the bottom of the lamp holder and insulated from the electrically conductive socket, an insulating ring assembly being hollow at its center and having at least one spring member mounted in its periphery, said insulating ring assembly being positioned within the electrically conductive socket so as to rest at the bottom thereof with the at least one spring member having an upper and lower spring arm both extending towards the center of the electrically conductive socket, a contact member comprising an insulated carrier having an electrically conductive button centrally located thereon and having arm portions at its periphery, said contact member being insertable into the electrically conductive socket whereby the upper and lower spring arms of said at least one spring member capture the arm portions of said contact member between them to retain it within said socket, said lower spring arm mounting said contact member such that in an unbiased condition said electrically conductive button is aligned with but spaced from the second electrical contact generally centrally located in the bottom of the lamp base, said electrically conducting button having a selected geometric configuration corresponding to a particular lamp wattage rating, said selected geometric configuration corresponding in a mating relationship with the geometric configuration of the centrally located electrical contact of a lamp base of corresponding wattage rating, whereby as a lamp of corresponding wattage rating is screwed into the lamp socket, its centrally located electrical contact mates with the selected geometric configuration of the contact member so that continued screwing-in of said lamp overcomes the bias of said lower spring arm to make electrical contact between the lamp socket central electrical contact and said electrically conductive button.

4. Apparatus in accordance with claim 3 wherein the geometric configurations of said electrically conductive button and the centrally located electrical contact of a lamp are selected such that said electrically conductive button of a geometric configuration corresponding to a particular wattage mates with the electrical contact of a lamp of that particular and lower wattages, and does not mate with the electrical contact of said lamp if said lamp is of a higher wattage rating.

5. In combination, lighting apparatus comprising a lamp holder and a lamp, said lamp holder including an insulated shell enclosing an electrically conductive socket which is threaded for receiving a lamp in screw-in relationship, a first electrical contact connected to the electrically conductive socket and a second electrical contact generally centrally located in the bottom of the lamp holder and insulated from the electrically conductive socket, a lamp having a base comprising an electrically conductive screw-threaded portion constituting one electrical contact, and a second lamp electrical contact generally centrally located in the bottom of the lamp base, a wattage limiting and safety device comprising an insulating ring assembly being hollow at its center and having at least one spring member mounted in its periphery, said insulating ring assembly being positioned within the electrically conductive socket so as to rest at the bottom thereof with the at least one spring member having an upper and lower spring arm both extending towards the center of the electrically conductive socket, a contact member comprising an insulated carrier having an electrically conductive button centrally located thereon and having arm portions at its periphery, said contact member being insertable into the electrically conductive socket whereby the upper and lower spring arms of said at least one spring member capture the arm portions of said contact member between them to retain it within said socket, said lower spring arm mounting said contact member such that in an unbiased condition said electrically conductive button is aligned with but spaced from the second electrical contact generally centrally located in the bottom of said lamp base, said electrically conducting button having a selected geometric configuration corresponding to a particular lamp wattage rating, said selected geometric configuration corresponding in a mating relationship with the geometric configuration of the centrally located electrical contact of said lamp base of corresponding wattage rating, whereby as said lamp of corresponding wattage rating is screwed into said socket, its centrally located electrical contact mates with the selected geometric configuration of the contact member so that continued screwing-in of said lamp overcomes the bias of said lower spring arm to make electrical contact between said lamp socket central electrical contact and said electrically conductive button.

6. Apparatus in accordance with claim 5 wherein the geometric configurations of said electrically conductive button and said centrally located electrical contact of said lamp are selected such that said electrically conductive button mates with the electrical contact of said lamp if that lamp is of a corresponding and lower wattage rating, and does not mate with the electrical contact of said lamp if that lamp is of a higher wattage rating.

7. In a standard Edison base lamp holder for light fixtures including a lamp holder having an insulated shell enclosing an electrically conductive socket which is threaded for receiving a lamp in screw-in relationship, and further including a first electrical contact connected to the electrically conductive socket and a second electrical contact generally centrally located in the bottom of the lamp holder and insulated from the electrically conductive socket, a wattage limiting and safety device comprising a plurality of spring members mounted within the electrically conductive socket at the bottom thereof at spaced positions around the periphery and extending inwardly said spring members each having an upper and lower spring arm both extending towards the center of the electrically conductive socket, a contact member comprising an insulated carrier having an electrically conductive button centrally located thereon and having arm portions at its periphery, said contact member being insertable into the electrically conductive socket whereby the upper and lower spring arms of said spring members capture the arms portions of said contact member between them to permanently retain it in a tamper-proof configuration within said socket, said lower spring arms mounting said contact member such that in an unbiased condition said electrically conductive button is aligned with but spaced from the second electrical contact generally centrally located in the bottom of the lamp base, said electrically conducting button having a selected geometric configuration corresponding to a particular lamp wattage rating, said selected geometric configuration corresponding in a mating relationship with the geometric configuration of the centrally located electrical contact of a standard Edison lamp base of corresponding wattage rating, whereby as a lamp of corresponding wattage rating is screwed into the lamp socket, its centrally located electrical contact mates with the selected geometric configuration of the contact member so that continued screwing-in of said lamp overcomes the bias of said lower spring arm to make electrical contact between the lamp socket central electrical contact and said electrically conductive button.

8. In a standard Edison base lamp holder for light fixtures including a lamp holder having an insulated shell enclosing an electrically conductive socket which is threaded for receiving a lamp in screw-in relationship, and further including a first electrical contact connected to the electrically conductive socket and a second electrical contact generally centrally located in the bottom of the lamp holder and insulated from the electrically conductive socket, a wattage limiting and safety device comprising a contact member comprising an insulated carrier having an electrically conductive button centrally located thereon, a plurality of spring members each having upper and lower arms with said upper arms mounted in the periphery of said insulated carrier at spaced positions around said periphery and said lower arms supporting the bottom thereof, said contact member being positioned in said electrically conductive socket at the bottom thereof with said plurality of spring members holding said contact member in place to inhibit removal of said contact member, said lower spring arms positioning the bottom of said insulated carrier such that in an unbiased condition said electrically conductive button is aligned with but spaced from the second electrical contact generally centrally located in the bottom of the standard Edison lamp base, said electrically conducting button having a selected geometric configuration corresponding to a particular lamp wattage rating, said selected geometric configuration corresponding in a mating relationship with the geometric configuration of the centrally located electrical contact of a standard Edison lamp base of corresponding wattage rating, whereby as a lamp of corresponding wattage rating is screwed into the lamp socket, its centrally located electrical contact mates with the selected geometric configuration of the contact member so that continued screwing-in of said lamp overcomes the bias of said lower spring arms to make electrical contact between the lamp socket central electrical contact and said electrically conductive button.

* * * * *